US007478507B2

(12) United States Patent
Krause

(10) Patent No.: US 7,478,507 B2
(45) Date of Patent: Jan. 20, 2009

(54) SPLICER AND SIDING PANEL ASSEMBLY

(75) Inventor: Walter M. Krause, Ashland, OH (US)

(73) Assignee: Associated Materials, LLC., Cuyahoga Falls, OH (US)

( * ) Notice: Subject to any disclaimer, the term of this patent is extended or adjusted under 35 U.S.C. 154(b) by 400 days.

(21) Appl. No.: 10/911,932

(22) Filed: Aug. 5, 2004

(65) Prior Publication Data

US 2006/0026921 A1 Feb. 9, 2006

(51) Int. Cl.
*E04D 1/34* (2006.01)
*E04B 1/38* (2006.01)

(52) U.S. Cl. ..... 52/546; 52/712

(58) Field of Classification Search ..... 52/520, 52/539, 543–547, 470–471, 586.1, 586.6, 52/550–551, 506.05, 712, 714–715, 508–510, 52/512, 748.1, 748.11, 536, 519; 256/24, 256/73; 403/286, 293–294; 405/262, 284; 428/603, 582–583, 597, 601, 577
See application file for complete search history.

(56) References Cited

U.S. PATENT DOCUMENTS

| | | | | | |
|---|---|---|---|---|---|
| 1,502,681 | A | * | 7/1924 | Pommersheim | 52/550 |
| 2,522,067 | A | | 9/1950 | Sperry | |
| 2,924,963 | A | * | 2/1960 | Taylor et al. | 52/509 |
| 3,265,420 | A | | 8/1966 | Goodrich et al. | |
| 3,437,360 | A | | 4/1969 | Gould et al. | |
| 3,504,467 | A | * | 4/1970 | Hatch et al. | 52/309.1 |
| 3,606,720 | A | | 9/1971 | Cookson | |
| 3,650,080 | A | | 3/1972 | Leale, Sr. | 52/469 |
| 3,858,370 | A | * | 1/1975 | Halstead | 312/352 |
| 3,966,157 | A | * | 6/1976 | Corral et al. | 248/217.3 |
| 3,977,145 | A | | 8/1976 | Dobby et al. | 52/531 |
| 4,272,576 | A | | 6/1981 | Britson | 428/100 |
| 4,356,673 | A | | 11/1982 | Gailey | 52/127.1 |
| 4,432,181 | A | | 2/1984 | Funaki | 52/459 |
| 4,439,970 | A | * | 4/1984 | Rosner | 52/511 |
| 4,450,665 | A | | 5/1984 | Katz | 52/522 |
| 4,736,565 | A | | 4/1988 | Bisson | 52/526 |
| 5,150,555 | A | | 9/1992 | Wood | 52/544 |

(Continued)

OTHER PUBLICATIONS along. (2001). In Chambers 21st Century Dictionary. Retrieved Mar. 26, 2008, from http://www.credoreference.com/entry/1188295.*

*Primary Examiner*—Robert J Canfield
*Assistant Examiner*—Christine T Cajilig
(74) *Attorney, Agent, or Firm*—Banner & Witcoff, Ltd.

(57) ABSTRACT

A splicing member for securing horizontally adjacent siding panels to one another in an abutting relationship includes a first substantially planar member having an upper edge and a lower edge. Each of a pair of flanges extends outwardly from opposed sides of the first substantially planar member proximate the upper edge. A shoulder extends inwardly from the lower edge of the first substantially planar member. A second substantially planar member extends downwardly from an inner edge of the shoulder. A pair of projections extends downwardly from the shoulder and outwardly from the second substantially planar member. A pair of siding panels include a substantially planar member with apertures formed therein and a flange extending rearwardly therefrom. Flanges extend outwardly form sides of the planar member. A shoulder extends inwardly from a lower edge of the planar member and a second substantially planar member extends downwardly from the shoulder.

29 Claims, 2 Drawing Sheets

U.S. PATENT DOCUMENTS

| | | | | | |
|---|---|---|---|---|---|
| 5,349,802 | A | | 9/1994 | Kariniemi | 52/543 |
| 5,461,839 | A | | 10/1995 | Beck | 52/519 |
| 5,537,792 | A | * | 7/1996 | Moliere | 52/531 |
| 5,553,434 | A | | 9/1996 | Tamura | 52/545 |
| 5,606,835 | A | | 3/1997 | Champagne | 52/545 |
| 5,661,939 | A | | 9/1997 | Coulis et al. | 52/519 |
| 5,675,955 | A | | 10/1997 | Champagne | 52/521 |
| 5,729,946 | A | | 3/1998 | Beck | 52/520 |
| 5,946,876 | A | | 9/1999 | Grace, Sr. et al. | 52/520 |
| 6,050,041 | A | | 4/2000 | Mowery et al. | 52/520 |
| 6,052,961 | A | * | 4/2000 | Gibbs | 52/518 |
| 6,122,877 | A | | 9/2000 | Hendrickson et al. | 52/520 |
| 6,295,777 | B1 | * | 10/2001 | Hunter et al. | 52/519 |
| 6,336,303 | B1 | * | 1/2002 | Vandeman et al. | 52/520 |
| 6,367,220 | B1 | * | 4/2002 | Krause et al. | 52/512 |
| 6,393,792 | B1 | | 5/2002 | Mowery et al. | 52/520 |
| 6,505,448 | B2 | * | 1/2003 | Ito | 52/474 |
| 7,010,894 | B1 | * | 3/2006 | Cappelle | 52/480 |
| 7,225,592 | B2 | * | 6/2007 | Davis | 52/547 |

* cited by examiner

SPLICER AND SIDING PANEL ASSEMBLY

FIELD OF THE INVENTION

This invention relates generally to a siding panel assembly, and, in particular, to a siding panel assembly having a splicing member for securing horizontally adjacent siding panels to one another.

BACKGROUND OF THE INVENTION

Siding, or wall siding, is commonly used to cover the exterior surfaces, e.g. walls, of structures. Such siding is often formed of metal, such as aluminum, or thermoplastic materials, such as polyvinyl chloride (PVC). Siding panels of such thin material are typically overlapped with horizontally adjacent panels to allow for thermal contraction and expansion. Other siding may be formed of thicker materials, for example, reinforced cement, or blends of polymer and wood fibers. Such siding panels cannot be overlapped due to their increased thickness. The vertical lateral edges between horizontally adjacent are butted together, but may tend to separate, forming unsightly gaps between horizontally adjacent panels.

Such siding is typically installed in multiple rows of panels, with each row overlapping the panels to which it is vertically adjacent. Adjoining panels are overlapped in this manner to provide protection for the structure from the elements.

Siding panels installed on vertical surfaces may be formed with one or more sections or courses. The courses are often combined with horizontal shoulders to form a siding profile. The courses may be declinations, that is, downwardly extending flat portions, which combine with the horizontal shoulders to form a clapboard profile. The courses may have a dutch lap construction, which includes an upper portion that angles downwardly and outwardly to an upper edge of a downwardly extending lower portion.

It is an object of the present invention to provide a splicer for a siding panel assembly that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a siding panel assembly with a splicer. In accordance with a first preferred embodiment, a splicing member for securing horizontally adjacent siding panels to one another in an abutting relationship includes a first substantially planar member having an upper edge and a lower edge. Each of a pair of flanges extends outwardly from opposed sides of the first substantially planar member proximate the upper edge. A shoulder extends inwardly from the lower edge of the first substantially planar member. A second substantially planar member extends downwardly from an inner edge of the shoulder. A pair of projections extends downwardly from the shoulder and outwardly from the second substantially planar member.

In accordance with another preferred embodiment, a siding panel assembly includes a pair of horizontally adjacent siding panels. Each panel includes a substantially planar member with an upper portion having a reduced thickness and being angled slightly outwardly from a front surface of the substantially planar member, defining a groove along a front surface of the substantially planar member. Each of a pair of first apertures is formed in the groove and is positioned proximate a lateral edge of the substantially planar member. A plurality of second apertures is formed in the groove laterally inward of the first apertures. A flange extends rearwardly from the substantially planar member proximate a lower edge thereof and terminates in a lip extending downwardly from a rear edge of the flange. A pair of notches is formed in the flange. A recess is formed in a rear surface of the substantially planar member beneath the flange. A splicing member includes a first substantially planar member having an upper edge and a lower edge. Each of a pair of flanges extends outwardly from an opposed side of the first substantially planar member proximate the upper edge, with each flange being received in one of the first apertures and bent upwardly along a front surface of the groove. A shoulder extends inwardly from the lower edge of the first substantially planar member. A second substantially planar member extends downwardly from an inner edge of the shoulder. A pair of projections extends downwardly from the shoulder and outwardly from the second substantially planar member, with each projection being received in a corresponding notch.

In accordance with a further embodiment, a siding panel assembly includes a pair of horizontally adjacent siding panels. Each panel has a substantially planar member formed of a mixture of a polymer and wood fiber, with an upper portion of the substantially planar member having a reduced thickness and being angled slightly outwardly from a front surface of the substantially planar member to define a groove along a front surface of the substantially planar member. Each of a pair of first apertures is formed in the groove, with each first aperture being positioned proximate a lateral edge of the substantially planar member. A plurality of second apertures is formed in the groove laterally inward of the first apertures. A flange extends rearwardly from the substantially planar member proximate a lower edge thereof and terminates in a lip extending downwardly from a rear edge of the flange. A pair of notches is formed in the flange. A recess is formed in a rear surface of the substantially planar member beneath the flange and curves upwardly and outwardly. A cap formed of a polymer encapsulates the siding panel. A splicing member includes a first substantially planar member having an upper edge and a lower edge. Each of a pair of flanges extends outwardly from an opposed side of the first substantially planar member proximate the upper edge, with each flange being received in one of the first apertures and bent upwardly along a front surface of the groove. A shoulder extends inwardly from the lower edge of the first substantially planar member. A second substantially planar member extends downwardly from an inner edge of the shoulder. Each of a pair of projections extends downwardly from the shoulder and outwardly from the second substantially planar member, with each projection being received in a corresponding notch and having a width slightly larger than a width of the corresponding notch.

In accordance with yet another embodiment, a siding panel assembly includes a pair of horizontally adjacent siding panels. Each panel has a substantially planar member formed of a mixture of a polymer and wood fiber, and has a top lock and a bottom lock. A pair of first apertures is formed in the top lock, with each first aperture being positioned proximate a lateral edge of the substantially planar member. A plurality of second apertures is formed in the top lock laterally inward of the first apertures. A pair of notches is formed in the bottom lock. A splicing member includes a first substantially planar member having an upper edge and a lower edge. Each of a pair of flanges extends outwardly from an opposed side of the first substantially planar member proximate the upper edge, with each flange being received in one of the first apertures and bent upwardly along a front surface of the top lock. A shoulder extends inwardly from the lower edge of the first substantially planar member. A second substantially planar member extends downwardly from an inner edge of the shoulder. Each of a pair of projections extends downwardly from the shoulder and outwardly from the second substantially planar member, with each projection being received in a corresponding notch.

Substantial advantage is achieved by providing a siding panel assembly with a splicer. In particular, certain preferred embodiments of the present invention allow horizontally adjacent siding panels formed of a blend of wood fiber and a polymer to be secured to one another in tight fitting fashion, providing a tight seal between them with no discernible gap and reducing the chance of moisture getting behind the siding panels.

These and additional features and advantages of the invention disclosed here will be further understood from the following detailed disclosure of certain preferred embodiments.

Figure 1:
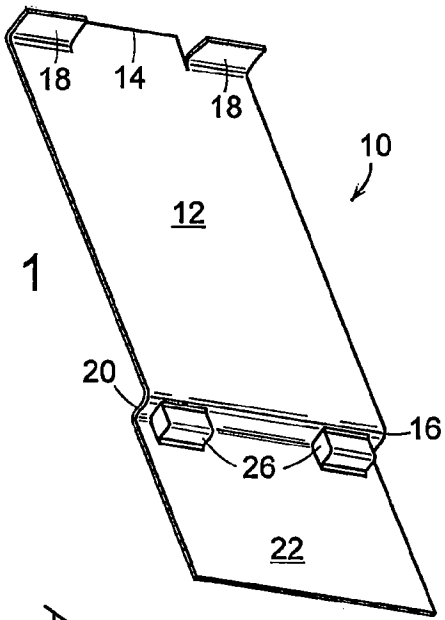
FIG. 1 is a perspective view of a splicer in accordance with a preferred embodiment of the present invention.

The figures referred to above are not drawn necessarily to scale and should be understood to provide a representation of the invention, illustrative of the principles involved. Some features of the siding panel assembly with a splicer depicted in the drawings have been enlarged or distorted relative to others to facilitate explanation and understanding. The same reference numbers are used in the drawings for similar or identical components and features shown in various alternative embodiments. Siding panel assemblies with splicers as disclosed herein would have configurations and components determined, in part, by the intended application and environment in which they are used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume wall siding attached to the walls of a structure such as a house. These directional references are given in reference to the surface plane, such as the ground, upon which the structure sits, and the plane of the wall of the structure itself. Horizontal, therefore, refers to a direction which is substantially parallel to the surface plane. Vertical refers to a direction which is substantially parallel to the wall of the structure and substantially perpendicular to the surface plane. Outwardly refers to a direction moving substantially horizontally away from the structure upon which the siding is attached while inwardly refers to a direction moving substantially horizontally toward the structure. Downwardly refers to a direction moving substantially vertically toward the surface plane and upwardly refers to a direction moving substantially vertically away from the surface plane. Lower and upper refer to vertical directions with lower being closer to the surface plane than upper. Left and right are in reference to directions given when one is looking at the structure.

The present invention may be embodied in various forms. A preferred embodiment of a splicing member or splicer 10 is shown in FIG. 1. In a preferred embodiment, splicer 10 is formed of metal, e.g., aluminum. Splicer 10 includes a first substantially planar member 12 having an upper edge 14 and a lower edge 16. Each of a pair of flanges 18 extends outwardly from an opposed side of planar member 12 proximate upper edge 14. In a preferred embodiment, each flange 18 is formed by cutting planar member 12 and folding a portion of planar member 12 outwardly. A shoulder 20 extends inwardly from lower edge 16. A second substantially planar member 22 extends downwardly from an inner edge 24 of shoulder 20. A pair of projections 26 extends downwardly from shoulder 26 and outwardly from second substantially planar member 22. In a preferred embodiment, splicer 10 and, naturally, projections 26 are formed by stamping a sheet of metal, e.g., aluminum.

Figure 3:
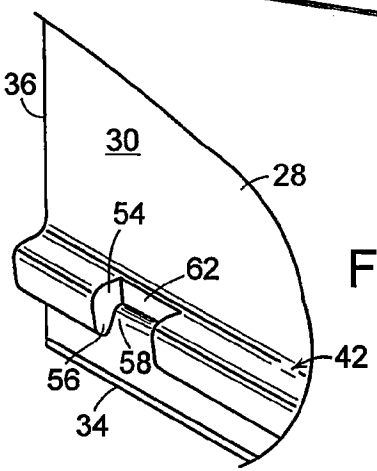
FIG. 3 is a perspective rear view, shown partially broken away, of a portion of a siding panel of FIG. 2.
Figure 2:
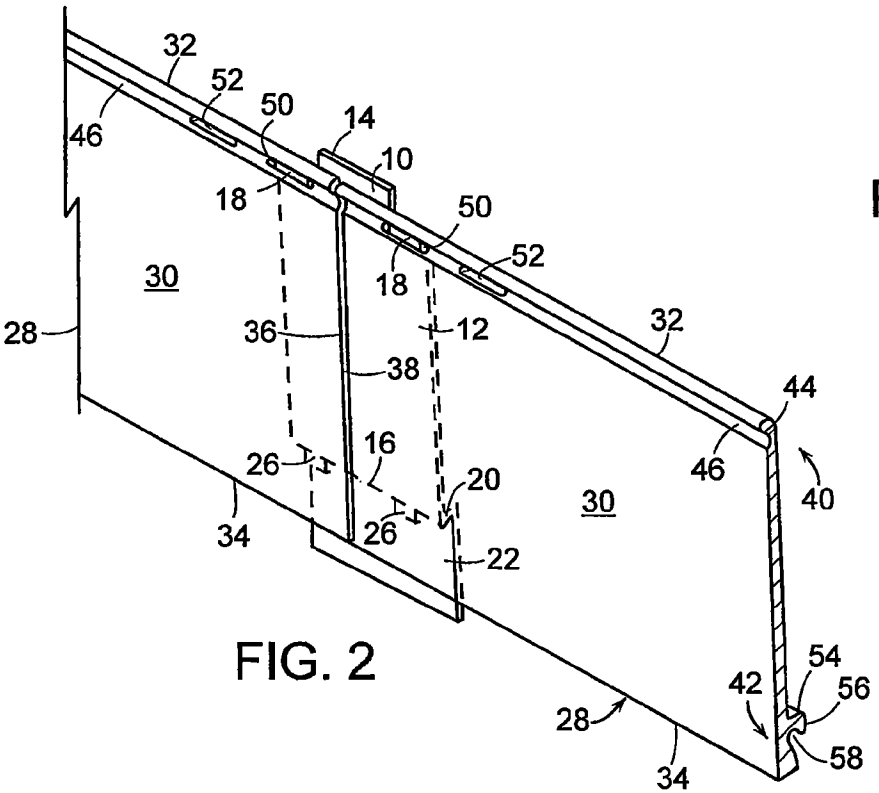
FIG. 2 is a perspective front view, shown partially broken away, of a pair of horizontally adjacent siding panels secured to one another with the splicer of FIG. 1.

Turning now to FIGS. 2 and 3, splicer 10 can be seen in use with a pair of horizontally adjacent siding panels 28. Siding panels 28 can have a wide variety of configurations, but preferably include a substantially planar member 30 having a top edge 32, a bottom edge 34, a left lateral edge 36 and a right lateral edge 38. A top lock 40 extends along substantially planar member 30 32 proximate top edge 32, and a bottom lock 42 extends along substantially planar member 30 32 proximate bottom edge 34. The top and bottom locks 40, 42 can have a wide range of shapes, and are configured to have complimentary shapes so that vertically adjacent siding panels can be interlocked together.

In a preferred embodiment, top lock 40 comprises a reduced thickness portion 44 of substantially planar member 30 that is angled slightly outwardly and defines a groove 46 along a front surface 48 of substantially planar member 30. A pair of first apertures 50 are located in groove 46, one first aperture 50 positioned proximate left lateral edge 36 of siding panel 28 and the other first aperture 50 positioned proximate right lateral edge 38 of siding panel 28. A plurality of second apertures 52 is located in groove 38 between the pair of first apertures 50. As described in greater detail below, second apertures 52 serve to receive fasteners, such as nails, to retain siding panel 28 to a structure. Thus second apertures 52 are spaced apart from one another a distance sufficient to retain siding panel 28 on the structure. In certain preferred embodiments, second apertures 52 are spaced 16 inches from one another along groove 46. However, it is to be appreciated that second apertures 52 may be spaced from one another at any desired distance. In a preferred embodiment, first apertures 40 and second apertures 46 are slots.

In the illustrated embodiment, bottom lock 42 comprises a flange 54 extending rearwardly from substantially planar member 30 proximate bottom edge 34 and terminating in a lip 56 extending downwardly from a rear edge of flange 54. A recess 58 is formed in a rear surface 60 of siding panel 28 beneath flange 54. In a preferred embodiment, recess 58 curves inwardly and upwardly and is configured to mate with and receive the angled reduced thickness portion 44 of a vertically adjacent siding panel 28 as described in greater detail below in connection with FIG. 4. As seen in FIG. 3, a pair of notches 62 are formed in flange 54 proximate each of left lateral edge 36 and right lateral edge 38 (the notch 62 proximate right lateral edge 38 is shown here from a back side of siding panel 28). Notches 62 are configured to receive corresponding projections 26 of splicers 10 when adjoining siding panels 28 are connected together as described in greater detail below. In a preferred embodiment, notches 62 have a width that is slightly smaller than a width of projections 26 so that projections 26 fit tightly into notches 62.

Siding panels 28 are secured to wall 64 of a building by way of nails 66 installed through second apertures 52. As noted above, apertures 52 have the form of slots in a preferred embodiment. As those skilled in the art can appreciate, nails 66 are driven into wall 64 only to the extent that they capture top lock 40 while allowing siding panel 28 to float, or move, longitudinally along wall 64, thereby accommodating thermal expansion and contraction of siding panel 28. It is to be noted that when successive rows of siding panels 28 are installed vertically above lower rows, the seams between horizontally adjacent siding panels 28 are offset from one another, both for aesthetic reasons and to reduce the chance of moisture getting behind siding panels 28.

Figure 4:
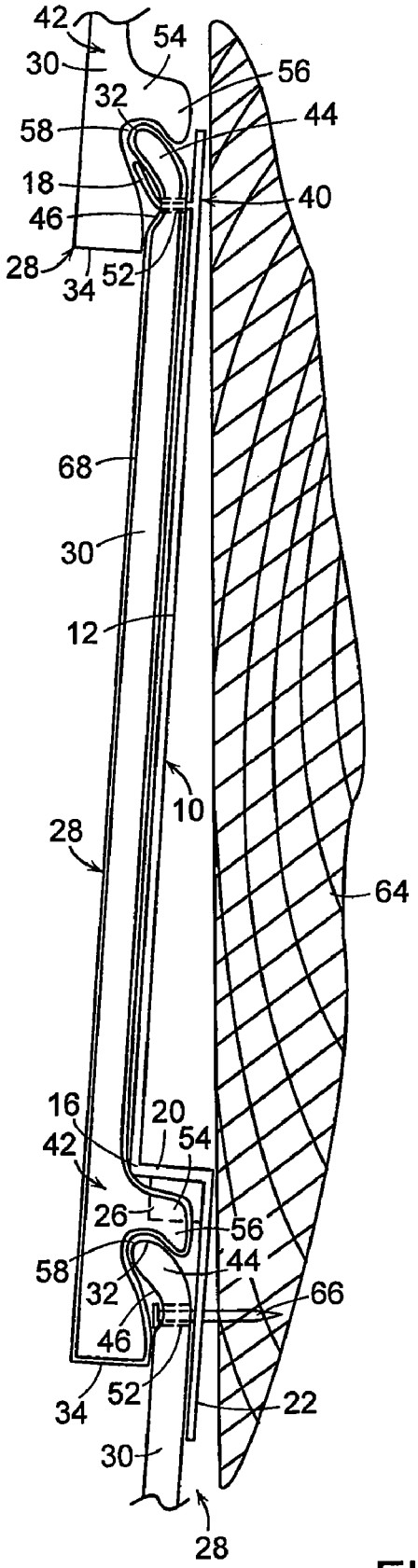
FIG. 4 is an elevation view of the siding panels of FIG. 2, shown installed on a wall of a structure with two vertically adjacent siding panels, each of which is shown partially broken away.

Horizontally adjacent siding panels 28 are secured to one another by splicer 10 as illustrated in FIGS. 2 and 4. A splicer 28 is first slid into position behind an installed siding panels 28 by slipping second substantially planar member 22 down behind the upper edge 32 of an installed siding panel 28 (seen in FIG. 4 as the lowermost siding panel 28, shown partially broken away).

A first siding panel 28 is then positioned above the previously installed siding panel 28 with its right or left lateral edge 36, 38 positioned approximately in the middle of splicer 10 and its bottom lock 42 of the first siding panel 28 engaged with the top lock 40 of the previously installed siding panel 28. As the first siding panel 28 engages the previously installed panel, its notch 62 is engaged with a corresponding projection 26 of splicer 10. As noted above, the engagement of projection 26 in notch 62 is preferably a tight fit. The flange 18 of splicer 10 above the corresponding projection 26 is extended through the corresponding first aperture 50 of the first siding panel 28 and then folded upwardly along a front surface of groove 46.

The second horizontally adjacent siding panel 28 is installed in similar fashion, with its bottom lock 42 engaging the top lock 40 of the previously installed siding panel 28, its notch 62 engaging the other projection 26 of splicer 10, and the other flange 18 of splicer 10 extending through the first aperture 50 of the second siding panel and bent upwardly along a front surface of groove 46. The horizontally adjacent first and second siding panels 28 are secured to wall 64 by way of nails 66, which are driven through second apertures 52 in known fashion.

In a preferred embodiment, the distance from notches 62 to the respective lateral edges of siding panel 28 and the spacing between projections 26 are sized such that when horizontally adjacent siding panels 28 are installed, a tight seal is formed between the siding panels with no discernible gap visible between them. This serves to enhance the aesthetic appeal of the siding and helps to prevent moisture from passing behind the siding panels 28. The expansion and contraction of siding panels 28 is accommodated at the ends of the rows of siding panels, where the corresponding left and right lateral edges 36, 38, respectively, are hidden behind trim pieces.

In a preferred embodiment, siding panels 28 are formed of a blend of polymer and wood fiber. In certain preferred embodiments, the polymer is PVC and the wood fiber is wood flour. As illustrated in FIG. 4, siding panel 28 may be encased within a cap 68. Cap 68 is preferably formed of a polymer, e.g., PVC, and serves to protect siding panel 68 from the elements and provides an aesthetically pleasing appearance. It is to be appreciated that in other embodiments siding panels 28 can be formed of other materials, e.g., reinforced concrete.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A splicing member for securing horizontally adjacent siding panels to one another in an abutting relationship comprising, in combination:

a first substantially planar member having an upper most edge and a lower most edge;

a pair of flanges extending outwardly from opposed sides of the first substantially planar member along and partially defining the upper most edge;

a shoulder extending inwardly from the entire lower most edge of the first substantially planar member;

a second substantially planar member extending downwardly from an inner most edge of the shoulder, a lower most edge of the second substantially planar member defining a lower most edge of the splicing member; and a pair of projections extending downwardly from the shoulder and outwardly from the second substantially planar member.

2. The splicing member according to claim 1, wherein the shoulder extends substantially horizontally.

3. The splicing member according to claim 1, wherein the splicing member is formed of metal.

4. The splicing member according to claim 1, wherein the splicing member is formed of aluminum.

5. The splicing member according to claim 1, wherein the splicing member is stamped from a sheet of metal.

6. The splicing member according to claim 1, wherein each flange comprises a portion of the first substantially planar member that is folded outwardly.

7. A siding panel assembly comprising, in combination:

a pair of siding panels configured to be installed horizontally adjacent one another, each panel comprising:

a substantially planar member, an upper portion of the substantially planar member having a reduced thickness and being angled slightly outwardly from a front surface of the substantially planar member defining a groove along the front surface of the substantially planar member;

a pair of first apertures formed in the groove, each first aperture being positioned proximate a lateral edge of the substantially planar member;

a plurality of second apertures formed in the groove laterally inward of the first apertures;

a flange extending rearwardly from the substantially planar member proximate a lower edge thereof and terminating in a lip extending downwardly from a rear edge of the flange;

a pair of notches formed in the flange;

a recess formed in a rear surface of the substantially planar member beneath the flange; and a splicing member comprising:

a first substantially planar member having an upper edge and a lower edge;

a pair of flanges extending outwardly from opposed sides of the first substantially planar member along the upper edge, each flange configured to be capable of being received in one of the first apertures and bent upwardly along a front surface of the groove;

a shoulder extending inwardly from the entire lower edge of the first substantially planar member;

a second substantially planar member extending downwardly from an inner edge of the shoulder; and a pair of projections extending downwardly from the shoulder and outwardly from the second substantially planar member, each projection configured to be capable of being received in a corresponding one of the notches.

8. The siding panel assembly according to claim 7, further comprising a pair of retaining members.

9. The siding panel assembly according to claim 8, wherein the retaining members are nails.

10. The siding panel assembly according to claim 7, wherein the splicing member is formed of metal.

11. The siding panel assembly according to claim 7, wherein the splicing member is formed of aluminum.

12. The siding panel assembly according to claim 7, wherein the substantially planar member is formed of a mixture of a polymer and wood fiber.

13. The siding panel assembly according to claim 12, wherein the polymer is PVC.

14. The siding panel assembly according to claim 12, wherein the wood fiber is wood flour.

15. The siding panel assembly according to claim 7, wherein each projection has a width slightly larger than a width of the notches.

16. The siding panel assembly according to claim 7, wherein the recess curves inwardly and upwardly.

17. A siding panel assembly comprising, in combination:

a pair of siding panels configured to be installed horizontally adjacent one another, each panel comprising:

a substantially planar member formed of a mixture of a polymer and wood fiber, an upper portion of the substantially planar member having a reduced thickness and being angled slightly outwardly from a front surface of the substantially planar member defining a groove along a front surface of the substantially planar member;

a pair of first apertures formed in the groove, each first aperture being positioned proximate a lateral edge of the substantially planar member;

a plurality of second apertures formed in the groove laterally inward of the first apertures;

a flange extending rearwardly from the substantially planar member proximate a lower edge thereof and terminating in a lip extending downwardly from a rear edge of the flange;

a pair of notches formed in the flange;

a recess formed in a rear surface of the substantially planar member beneath the flange and curving upwardly and outwardly; and a cap formed of a polymer and encapsulating the siding panel; and a splicing member comprising:

a first substantially planar member having an upper edge and a lower edge;

a pair of flanges extending outwardly from opposed sides of the first substantially planar member proximate the upper edge, each flange configured to be received in one of the first apertures and bent upwardly along a front surface of the groove;

a shoulder extending inwardly from the lower edge of the first substantially planar member;

a second substantially planar member extending downwardly from an inner edge of the shoulder; and a pair of projections extending downwardly from the shoulder and outwardly from the second substantially planar member, each projection configured to be received in a corresponding notch and having a width slightly larger than a width of the corresponding one of the notches.

18. A siding panel assembly comprising, in combination:

a pair of siding panels configured to be installed horizontally adjacent one another, each panel comprising:

a substantially planar member formed of a mixture of a polymer and wood fiber having a top lock and a bottom lock;

a pair of first apertures formed in the top lock, each first aperture being positioned proximate a lateral edge of the substantially planar member;

a plurality of second apertures formed in the top lock laterally inward of the first apertures;

a pair of notches formed in the bottom lock; and a splicing member comprising:

a first substantially planar member having an upper edge and a lower edge;

a pair of flanges extending outwardly from opposed sides of the first substantially planar member along the upper edge, each flange configured to be received in one of the first apertures and bent upwardly along a front surface of the top lock;

a shoulder extending inwardly from the entire lower edge of the first substantially planar member;

a second substantially planar member extending downwardly from an inner edge of the shoulder; and a pair of projections extending downwardly from the shoulder and outwardly from the second substantially planar member, each projection configured to be received in a corresponding one of the notches.

19. The siding panel assembly according to claim 18, wherein the top lock comprises a reduced thickness portion of the substantially planar member that is angled slightly outwardly and defines a groove along a front surface of the substantially planar member.

20. The siding panel assembly according to claim 18, wherein the bottom lock comprises a flange extending rearwardly from the substantially planar member proximate a lower edge thereof and terminating in a lip extending downwardly from a rear edge of the flange, a recess being formed in a rear surface of the substantially planar member beneath the flange and the notches being formed in the flange.

21. A siding panel assembly comprising, in combination:

a pair of siding panels configured to be installed horizontally adjacent one another, each panel comprising:

a substantially planar member having opposed lateral edges and a pair of apertures, each aperture being positioned proximate one of the lateral edges;

a flange extending rearwardly from the substantially planar member proximate a lower edge thereof;

a pair of notches formed in the flange; and a splicing member comprising:

a first substantially planar portion having an upper edge and a lower edge;

a pair of flanges extending outwardly from opposed sides of the first substantially planar portion along the upper edge, each flange configured to be received in one of the apertures and bent upwardly along a front surface of the substantially planar member;

a shoulder extending inwardly from the entire lower edge of the first substantially planar portion;

a second substantially planar portion extending downwardly from an inner edge of the shoulder; and a pair of projections extending downwardly from the shoulder and outwardly from the second substantially planar portion, each projection configured to be received in a corresponding one of the notches.

22. The siding panel assembly according to claim 21, wherein an upper portion of the substantially planar member has a reduced thickness and is angled slightly outwardly from a front surface of the substantially planar member to define a groove along a front surface of the substantially planar member.

23. The siding panel assembly according to claim 21, further comprising a lip extending downwardly from a rear edge of the flange.

24. The siding panel assembly according to claim 21, further comprising a recess formed in a rear surface of the substantially planar member beneath the flange.

25. The siding panel assembly according to claim 21, wherein the splicing member is formed of metal.

26. The siding panel assembly according to claim 21, wherein the substantially planar member is formed of a mixture of a polymer and wood fiber.

27. The siding panel assembly according to claim 26, wherein the polymer is PVC.

28. The siding panel assembly according to claim 26, wherein the wood fiber is wood flour.

29. The siding panel assembly according to claim 21, wherein each projection has a width slightly larger than a width of one of the notches in one of the siding panels.

* * * * *